US005782118A

United States Patent [19]

Chamberlain et al.

[11] Patent Number: 5,782,118

[45] Date of Patent: Jul. 21, 1998

[54] LOCKSET WITH MOTORIZED SYSTEM FOR LOCKING AND UNLOCKING

[75] Inventors: L. C. Derek Chamberlain; Frederick M. Hensley, both of Colorado Springs, Colo.

[73] Assignee: Schlage Lock Company, San Francisco, Calif.

[21] Appl. No.: 682,173

[22] Filed: Jul. 16, 1996

[51] Int. Cl.[6] ..... E05B 47/00

[52] U.S. Cl. ..... 70/279; 70/277; 70/283

[58] Field of Search ..... 70/107, 277–283, 70/221–224, 218, 467–472; 292/144

[56] References Cited

U.S. PATENT DOCUMENTS

| | | | |
|---|---|---|---|
| 2,018,093 | 10/1935 | Schlage | 70/91 |
| 2,738,666 | 3/1956 | Tornoe | 70/216 |
| 2,998,274 | 8/1961 | Russell | 292/169 |
| 3,894,417 | 7/1975 | Taniyama | 70/156 |
| 3,916,656 | 11/1975 | Schlage | 70/148 |
| 3,955,387 | 5/1976 | Best et al. | 70/224 |
| 4,073,527 | 2/1978 | Schlage | 292/347 |
| 4,583,382 | 4/1986 | Hull | 70/107 |
| 4,604,879 | 8/1986 | Neary et al. | 70/224 |
| 4,920,773 | 5/1990 | Surko, Jr. | 70/224 |
| 4,956,984 | 9/1990 | Chi-Cheng | 70/277 |
| 5,010,752 | 4/1991 | Lin | 70/277 |
| 5,018,375 | 5/1991 | Tully | 70/472 |
| 5,040,391 | 8/1991 | Lin | 70/277 |
| 5,083,122 | 1/1992 | Clark | 340/825.32 |
| 5,421,178 | 6/1995 | Hamel | 70/283 |
| 5,473,236 | 12/1995 | Frolov | 318/286 |
| 5,474,348 | 12/1995 | Palmer et al. | 292/339 |
| 5,628,216 | 5/1997 | Qureshi et al. | 70/279 |
| 5,694,798 | 12/1997 | Nunez et al. | 70/283 |

FOREIGN PATENT DOCUMENTS

| | | |
|---|---|---|
| 0 219 694 | 4/1987 | European Pat. Off. . |
| 0 349 452 | 1/1990 | European Pat. Off. . |
| 0 551 147 | 7/1993 | European Pat. Off. . |
| 9403769 | 4/1994 | Germany . |
| WO84/03909 | 10/1984 | WIPO . |
| WO95/00733 | 1/1995 | WIPO . |

*Primary Examiner*—Suzanne Dino Barrett

*Attorney, Agent, or Firm*—Robert F. Palermo; Michael H. Minns

[57] ABSTRACT

A door lock, preferably operable both by a mechanical key with a key cylinder and by an electronic signal and having inside and outside handles mounted on inside and outside hollow spindles, for mounting on a door having an inside face and an outside face, has a cylindrical lock chassis with a provision for retracting a latch bolt in response to rotation of either of the hollow spindles; a member for selectively locking the outside spindle against rotation; a reversible electric motor mounted coaxially within the inside spindle, the motor being secured against rotation but free to slide axially against resistance provided by a biasing member, and having a motor shaft extending through the cylindrical lock chassis to operably engage the member for locking the outside spindle; a power supply for the motor; and a mechanism for selectively moving the member between locked and unlocked positions.

19 Claims, 10 Drawing Sheets

LOCKSET WITH MOTORIZED SYSTEM FOR LOCKING AND UNLOCKING

BACKGROUND OF THE INVENTION

This invention relates generally to electronic door locks and more particularly to locks having locking and unlocking functions driven by rotary DC motors in addition to mechanical key override.

Electrically operated door locksets are well known in the door lock industry. Typically they are "hard wired" from the standard AC system of the building through a transformer to operate a solenoid actuator in the lockset. The use of a rotary DC motor in place of a solenoid consumes less power and provides opportunities to employ the lock in battery powered "stand alone" installations. Because of the high power consumption of solenoid actuators, they are not practical for use in such installations.

Generally, in such systems, the locking function is carried out by an axially movable locking lug for simultaneously engaging slots in the outside spindle and the lock mounting hub to prevent turning of the spindle. Rotary DC motors are the preferred actuators for electronic locks; because they draw only low power. However, at stalled condition, such motors may burn out, and the electronics logic may become out of phase with the state of the lock mechanical components after a motor stall. Some presently available electronic locks employ springs between the motor drive and the locking lug to store energy from the motor during a "hang-up" condition. Such a condition may be caused, for example, by leaning on the door lever or knob while operating the lock and is ended when the leaning pressure is released. The energy may be stored between the motor drive coupling and the rotary-to-linear motion converter device, within the rotary-to-linear motion converter device, or between the rotary-to-linear motion converter device and the locking lug. In any case, this energy storage allows the motor to complete its cycle without stalling, thereby remaining in phase with the mechanical components of the lock. When the "hang-up" is released, the spring releases its energy to drive the locking lug to the required locked or unlocked condition.

Since the locking lug is held in the locking position by the spring bias, it follows that anything that can overcome the force of the spring bias, even momentarily, can be used to defeat the lock. Thus, a sharp axial blow to the outside spindle can cause the locking lug to momentarily bounce out of the hub locking slot and momentarily allow the handle to be turned to open the door.

Finally, during assembly of the locksets, the build-up of axial tolerances of components in the spindle may cause a tension or compression pre-load on the spring and thereby disturb timing between the electronic and mechanical parts of the lockset. To assure repeatable trouble free operation of the lock, such tolerance build-up must be compensated for. This requires a degree of adjustability of the components to allow for random variations of part dimensions and to complete assembly of the lock with zero load on the spring. Such adjustments are often very difficult due to limited access to set screws and other adjustment devices in an assembled lockset.

The foregoing illustrates limitations known to exist in present electronic/mechanical locksets. It would, therefore, be of benefit to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door lock, operable by an electronic signal and having inside and outside handles mounted on inside and outside hollow spindles, for mounting on a door having an inside face and an outside face, the door lock comprising a cylindrical lock chassis having a provision for retracting a latch bolt in response to rotation of either of the hollow spindles; a lock member for locking the outside spindle against rotation; a reversible electric motor mounted coaxially within the inside spindle, the motor being secured against rotation but free to slide axially against resistance provided by a biasing member, and having a motor shaft extending through the cylindrical lock chassis to operably engage the lock member for locking the outside spindle; a power supply for the motor; and a mechanism for moving the lock member between unlocked and locked positions.

These and other aspects will become apparent from the following detailed description of the invention when considered in conjunction with the accompanying drawings.

DETAILED DESCRIPTION

Figure 1:
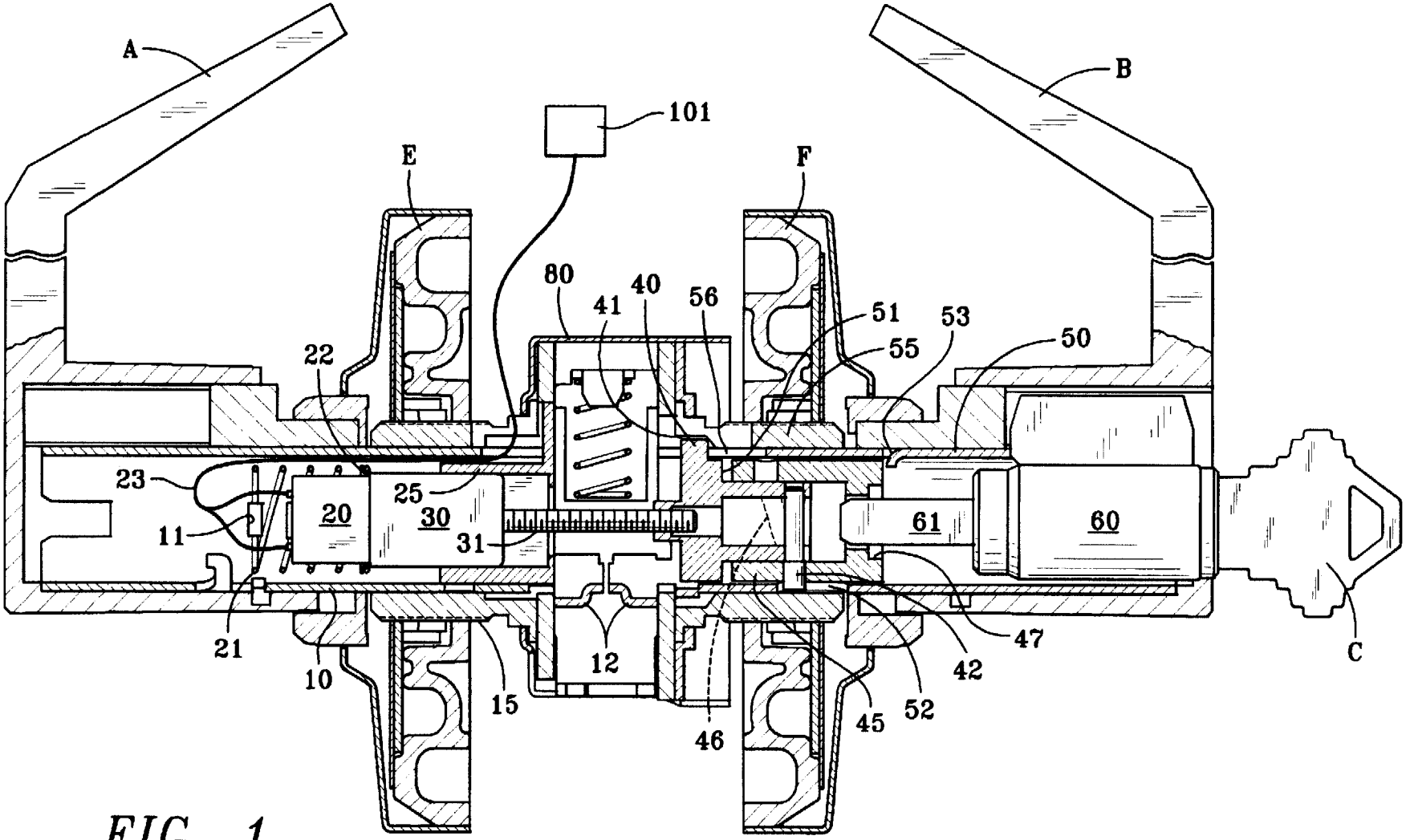
FIG. 1 is a longitudinal cross-sectional schematic plan view with the locking lug and locking slots rotated into the horizontal plane to illustrate the most important features of the motorized lockset of the invention.

FIG. 1 shows an electromechanical lockset embodying the general structure of the invention incorporated in a cylindrical lock. The structure and operation of cylindrical locks is well known and is described in some detail in U.S. Pat. Nos. 2,018,093 to Walter R. Schlage, 3,916,656 to Ernest Schlage, and 4,604,879 to Ralph Neary, et al., which are incorporated herein by reference. Inside lever A and outside lever B are attached to inside spindle 10 and outside spindle 50, respectively. Either lever may be turned to operate its spindle, each of which has at least one roll-back cam 12 at its inboard end for operating a latch retracting cam, not shown, within the cylindrical lock housing 80. Inside hub 15 and outside hub 55 are fixed to the cylindrical lock housing 80 and provide journal support to inside 10 and outside 50 spindles which project outwardly through the hubs. The hubs 15, 55 are externally threaded to permit attachment of inner mounting plate E and outer mounting plate F to the lock housing 80 for mounting in a door.

Figure 3:
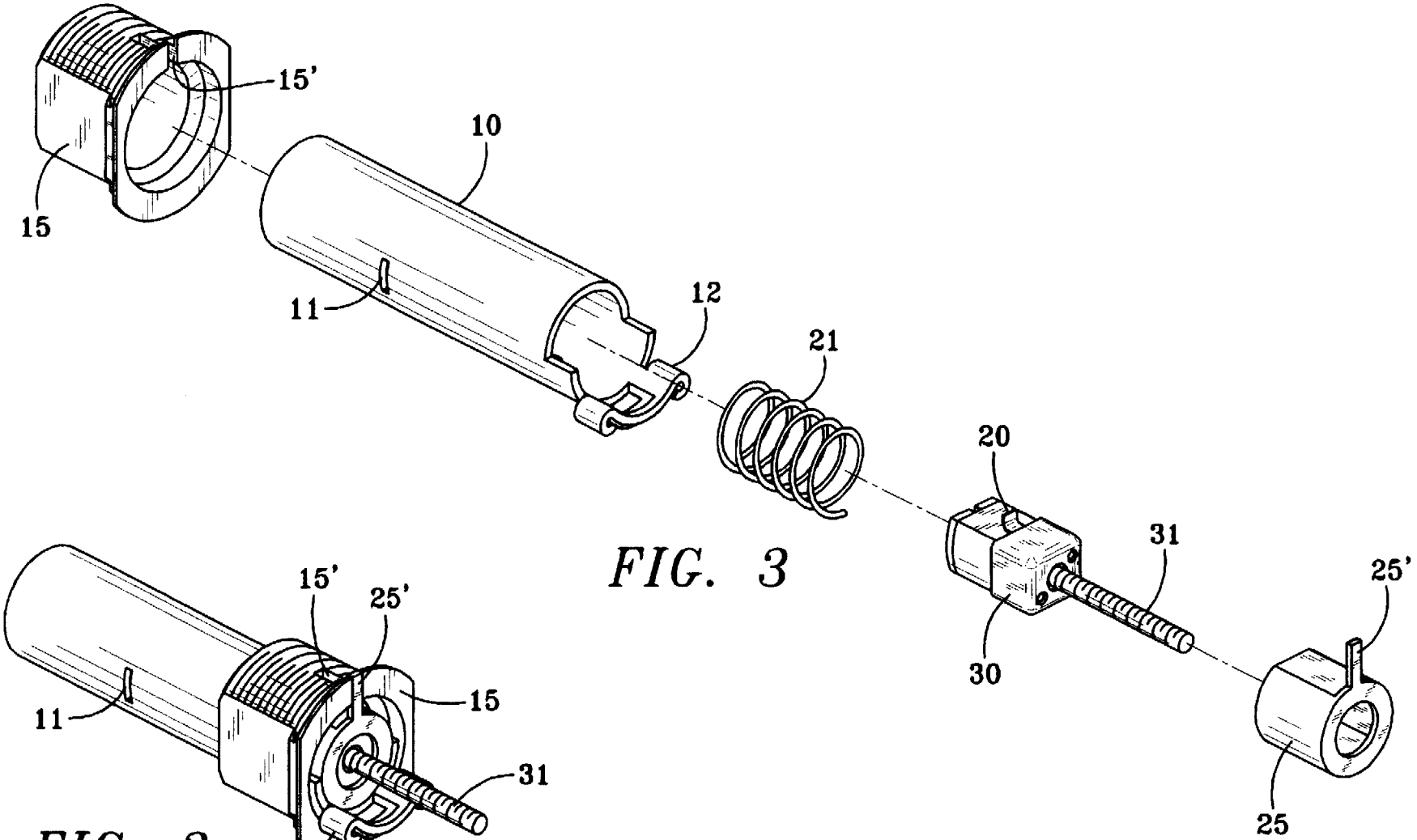
FIG. 3 is a perspective exploded schematic view of the spindle/hub/motor assembly of FIG. 2.
Figure 2:
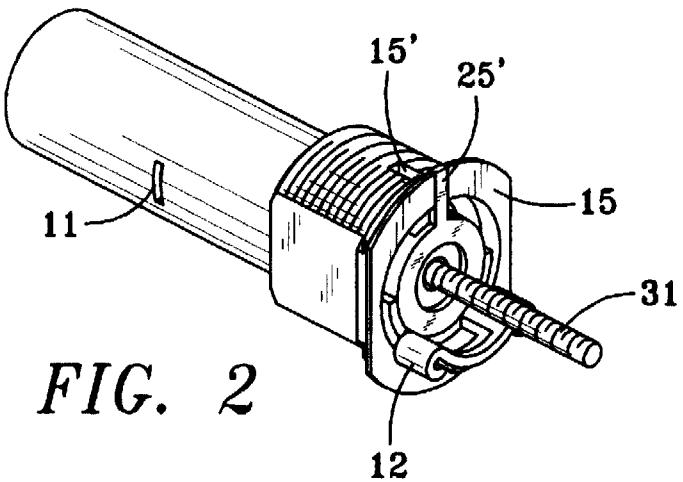
FIG. 2 is a perspective schematic view of an inside spindle/hub/motor assembly.
Figure 2A:
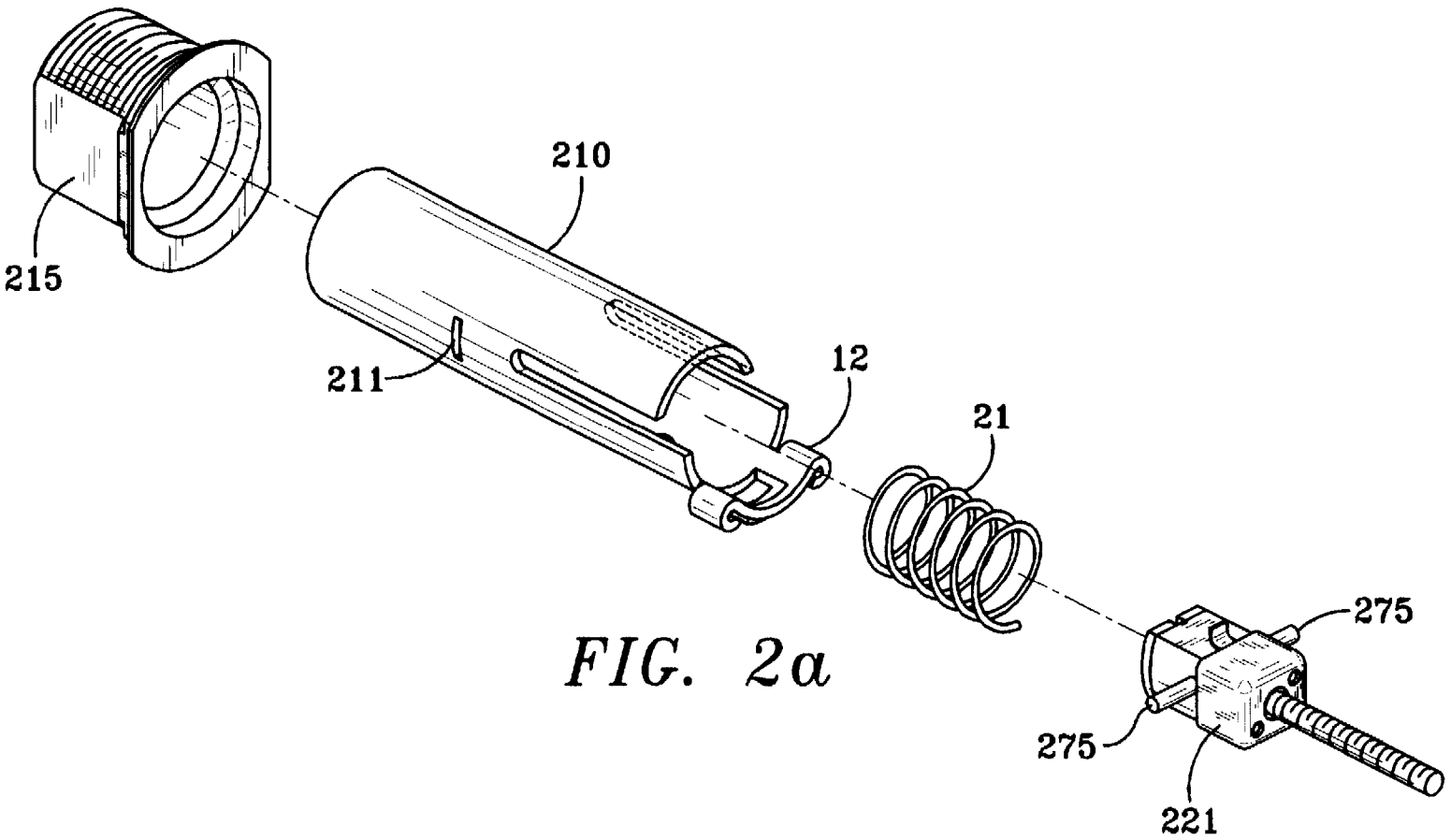
FIG. 2*a* is a perspective exploded schematic view showing an alternative motor mounting arrangement.

Referring to FIGS. 1 to 3, sleeve 25, having a cylindrical outer surface and an inner surface which substantially forms a rectangular parallelepiped, is journaled within the inboard end of inside spindle 10. Inside spindle 10 has a portion of its wall cut away over approximately half of its circumference at its inboard end, which may slightly exceed the length of the slot 15' in hub 15. A lug 25' protrudes radially outwardly from the inboard end of the sleeve 25 and nests in slot 15' in inside hub 15 to prevent rotation of the sleeve 25 with respect to hub 15. A DC electric motor 20 has a flexible cord 23 connecting it to a power supply 101, is axially disposed within spindle 10, and has a gear box 30 from which an output shaft 31 extends through the cylindrical lock housing 80. Gear box 30 has a rectangular cross-section and a sliding fit within sleeve 25 so that the assembly of motor 20, gear box 30, and output shaft 31 is free to slide axially and rotate with respect to the inside spindle 10 but is free only to slide with respect to the sleeve 25 and the hub 15. This same rotary restraint together with axial sliding freedom within the spindle 10 can be provided, as in FIG. 2*a*, by axial slots 211 in the wall of inside spindle 210 and lugs 275 protruding from the motor 220 into the slots 211, so the motor 221 is free to slide but not to rotate with respect to the spindle 210. Since the sleeve and lug 25 and 25' of the first embodiment is not used, hub 215, with no slot may be used. In either embodiment, the motor is axially biased to resist axial motion, either toward or away from the cylindrical lock housing 80, by a spring 21 which is attached, at the inboard end, to motor 20 by spring retainers 22 on motor 20 and, at the outboard end, to inside spindle 10 by diametrically opposed spring clamp slots 11 in the wall of the inside spindle. Other embodiments of the motor biasing means are possible, and some of those will be described below.

The axially free radially constrained motor mounting scheme prevents the motor 20 from reaching a stalled condition during its programmed running cycle, whether locking or unlocking the lockset. Thus, the motor 20 turns the output shaft 31 for as many turns as required to lock or unlock the lockset, as the case may be. If a "hang-up" condition exists, such as could be caused by a person leaning on the door lever, the motor will complete its full run cycle without stalling; because the rotary work done by the motor will be stored as energy in the spring 21, which, upon release of the hang-up, will convert to equivalent axial motion of the motor 20, the gear box 30, the output shaft 31, and the locking lug 41.

Figure 4:
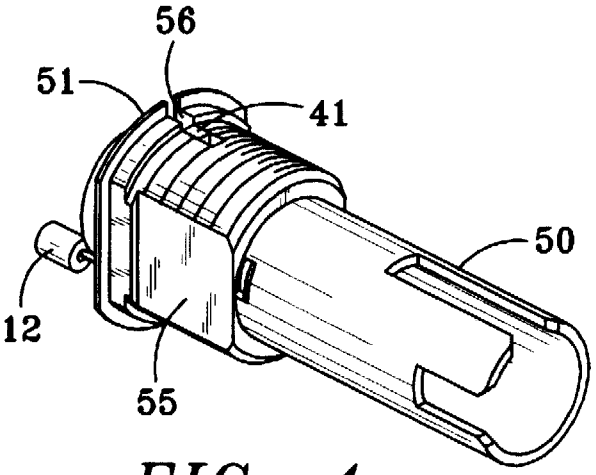
FIG. 4 is a perspective schematic view of an outside spindle/hub/spiral cam/locking lug assembly with the locking lug in the locked position.
Figure 5:
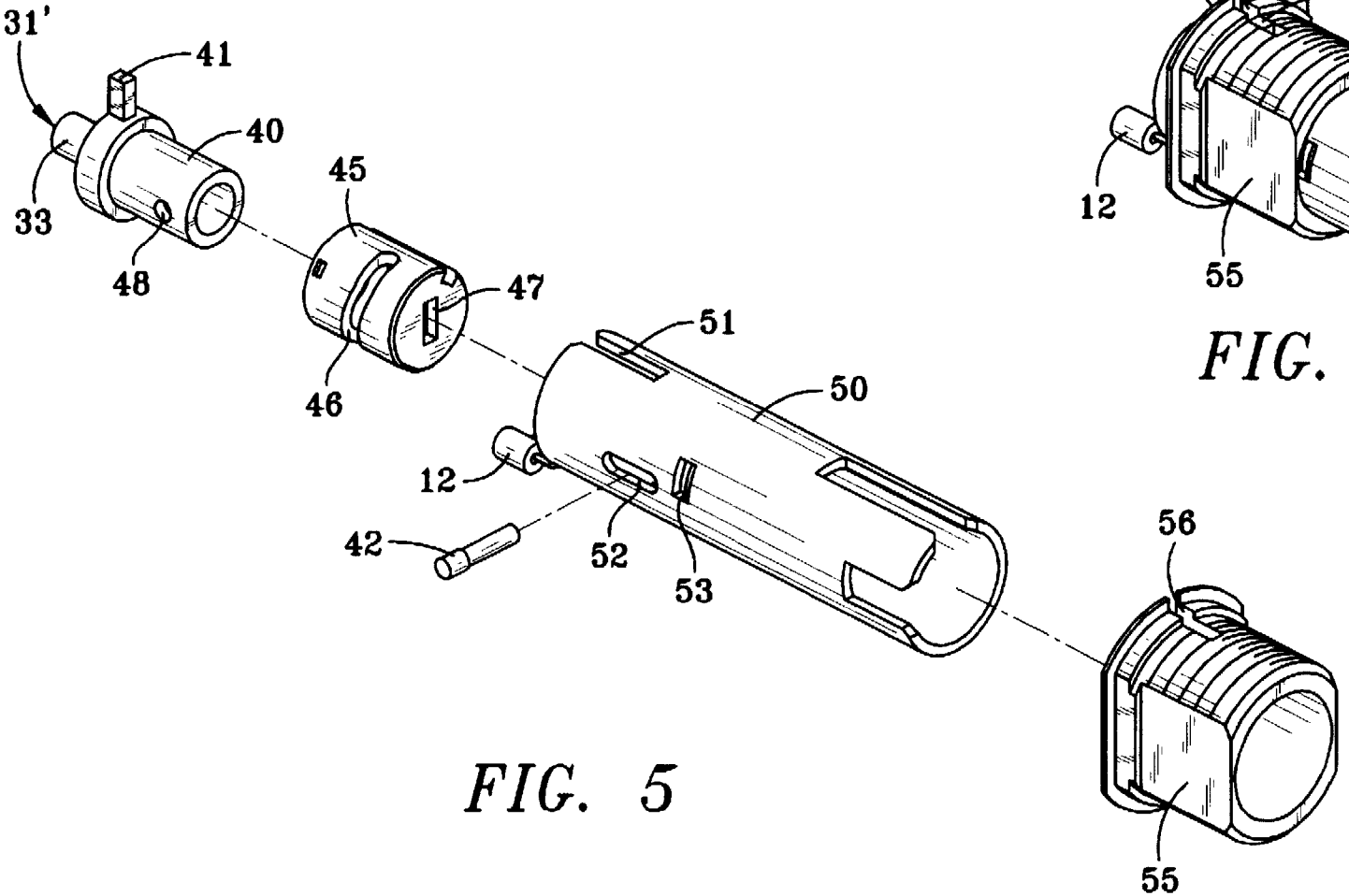
FIG. 5 is an exploded perspective schematic view of the assembly of FIG. 4.

Locking is illustrated in FIGS. 1,4, and 5 and is achieved by preventing rotation of the outside spindle 50 to prevent motion of the roll-back cam 12 and the consequent motion of the latch retracting cam in the cylindrical lock housing 80. As seen in FIG. 4, in the assembled state, outside spindle 50 has an axial locking slot 51 which extends in the inboard direction beyond hub locking slot 56 of outside hub 55. Spindle locking slot 51 aligns with hub locking slot 56 when the handle B is in its parked position. A cylindrical cam plug 40, as in FIG. 5, with a locking lug 41 protruding radially outwardly at an inboard end is disposed within a spiral cam 45. The spiral cam 45 is mounted within outside spindle 50, inboard of and abutting a cam stop 53 protruding radially inwardly from the wall of spindle 50, and is connected thereto by a cross pin 42 which protrudes through a pin slot 52 in the spindle wall through a spiral aperture 46 in spiral cam 45 and into transverse holes 48 of the cam plug 40. When the spiral cam 45 is rotated, the cam plug 40 is driven axially by the interaction of the cross pin 42 and the spiral aperture 46 of the spiral cam 45. Cross pin 42 is free to slide axially in the pin slot 52 of outside spindle 50 and to accommodate the motion of cam plug 40 caused by the cross pin 42 occupying the pin slot 52, the spiral slot 46, and the transverse holes 48, simultaneously, of the outside spindle 50, the spiral cam 45, and the cam plug 40, respectively. When the spiral cam 45 is turned clockwise, as viewed in FIG. 5, the spiral aperture 46 causes cross pin 42 to move toward the inboard end of pin slot 52 of outside spindle 50, and, because the pin also is in the transverse holes 48 of cam plug 40, it also drives the cam plug 40 toward the inboard end of the spindle 50. This results in the locking lug 41 disengaging from hub locking slot 56 and the outside handle B being freed for rotation. Note that, if the spiral cam 45 is turned by the tailpiece 61 of the key cylinder 60 using the key C, this action does not rotate the motor 20 or its output shaft 31. It merely pushes the motor toward the outboard end of inside spindle 10 and compresses spring 21. Conversely, when the key C is rotated counterclockwise, the spiral cam 45 produces the opposite result and locks the outside spindle 50 to the outside hub 55, at the same time relaxing spring 21. The motion of locking lug 41 is the same whether it is driven by the rotation of the spiral cam 45 or by the operation of the electric motor 20.

Cam plug 40 has a hub 33 which has an internally threaded hole 31' for engaging the threads on the output shaft 31 of the motor 20. When the motor 20 turns the shaft 31, the cam plug 40 together with the spiral cam 45 and the cross pin 42 is either pushed toward its locking position in the hub locking slot 56 or pulled toward the motor 20 and gear box 30. When pulled toward the motor, the locking lug 41 is disengaged from the outside hub locking slot 56 but still engaged in the spindle locking slot 51. This is due to the spindle locking slot 51 extending beyond the outside hub locking slot 56. When pushed toward the outboard end of spindle 50, the locking lug 41 protrudes radially through slots 51 and 56 of outside spindle 50 and hub 55, respectively, thus preventing relative rotation.

If the key C is turned in key cylinder 60, it causes the tailpiece 61, which extends from the key cylinder 60 into the spiral cam 45 through the aperture 47 to turn. The shape of aperture 47 in FIG. 5 is suited for direct drive, although other shapes are possible which will allow, for example, for various amounts of lost motion. The exact shape of aperture 47 is not critical and will not be further discussed.

Figure 6:
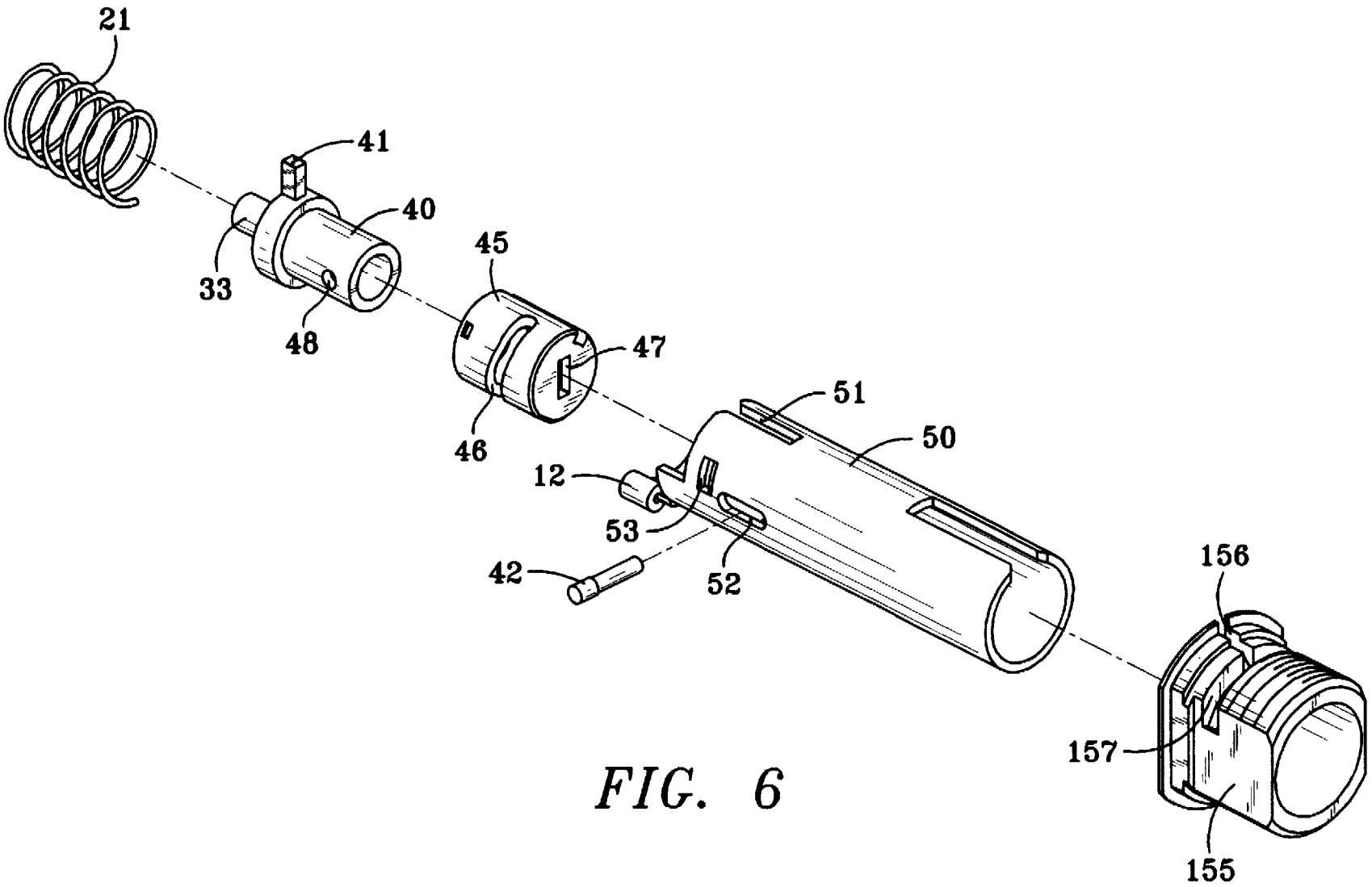
FIG. 6 is an exploded perspective view showing a modification to the outside hub and spindle to maintain the locked condition when subjected to impacts.

The locking arrangement in FIG. 6 is different from that already described in that the outside hub 155 is designed in reverse of that of the previous embodiment. The hub locking slot 156 is the same, but there is a circumferential slot 157 subtending about 140° of arc of the hub 155 and intersecting the hub locking slot 156. In the locked condition, the locking lug 41 is positioned in hub locking slot 156, while, in the unlocked state, the locking lug 41 is positioned in circumferential slot 157, outboard of the locking slot 156. This arrangement prevents defeat of the lock by axially impacts on the outside handle B to cause the spring biased locking lug 41 to bounce out of the locking slot as can be done to the lock of the previous embodiment. This is possible because of the spring bias which is required to avoid motor burn-out under hang-up conditions. Since the locking lug 41 is held in the hub locking slot only by the spring bias in the previous embodiment, the impulse of the impact transfers through the spindle to the locking lug, causing the lug to bounce against the bias of the spring and to disengage from the locking slot.

Figure 7B:
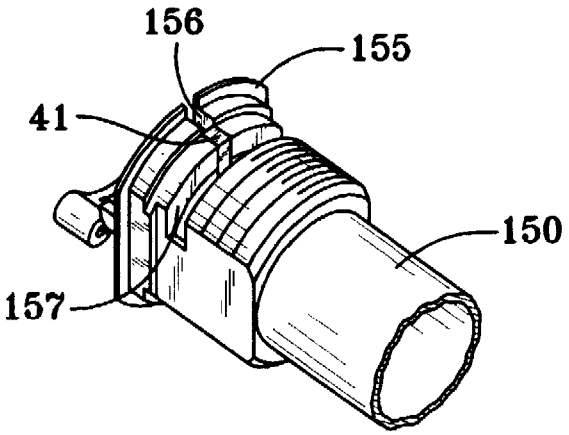
FIGS. 7*a* and 7*b* show the locking lug of FIG. 6 in unlocked and locked conditions, respectively.
Figure 7A:
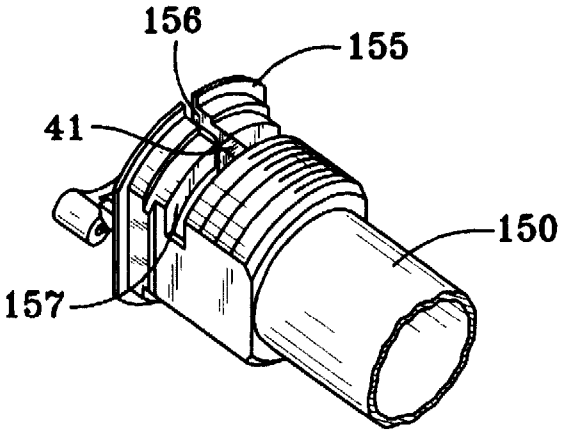

With the inwardly moving locking action in this embodiment, the inward impulse of the locking lug 41 is dissipated by contact of the spiral cam 45 with cam stop 153 in outer spindle 150, so the locking lug 41 remains engaged in the locking slot 156. Of course, locking and unlocking motions are in opposite directions from those of the previous embodiment with the locking lug moving toward the outboard end of the spindle to unlock the spindle from the hub and toward the inboard end to lock the spindle to the hub. FIGS. 7*a* and 7*b* show the unlocked and locked states, respectively.

Figure 8:
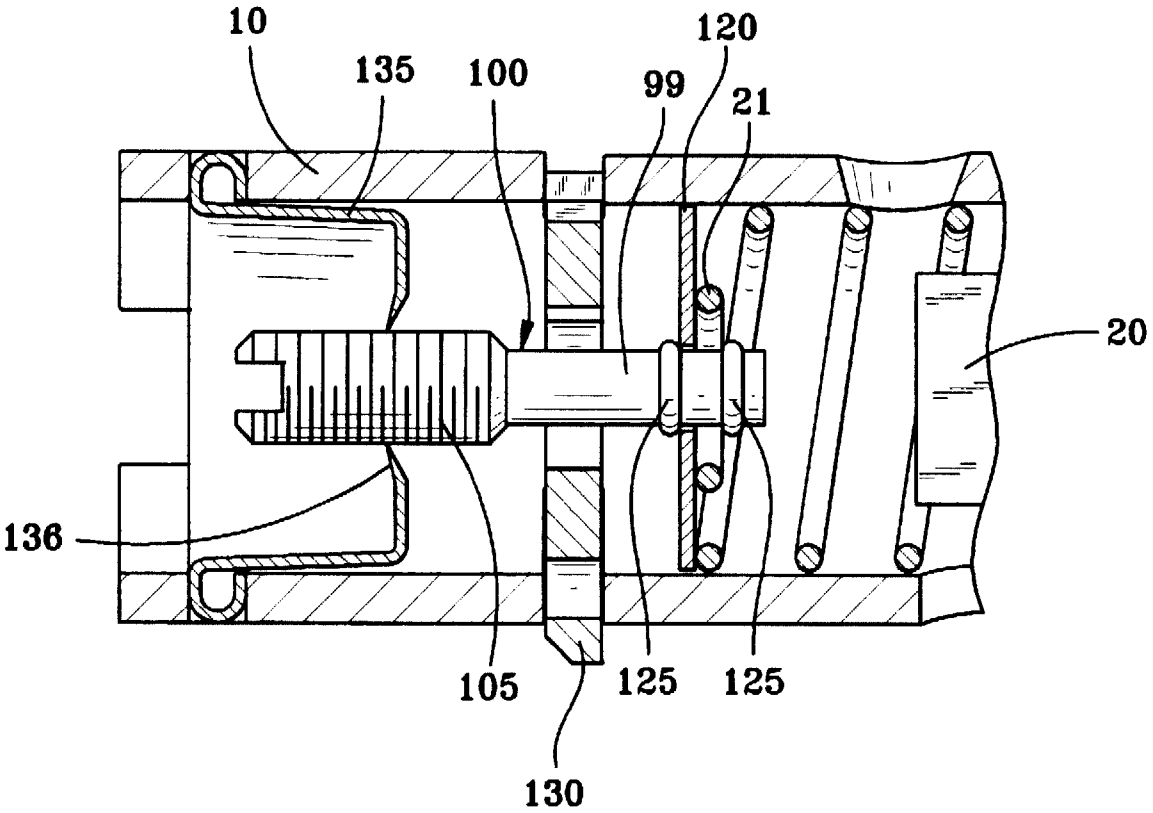
FIG. 8 is a fragmentary schematic cross-sectional plan view of an adjustable biasing arrangement for mounting the motor within the spindle.
Figure 9:
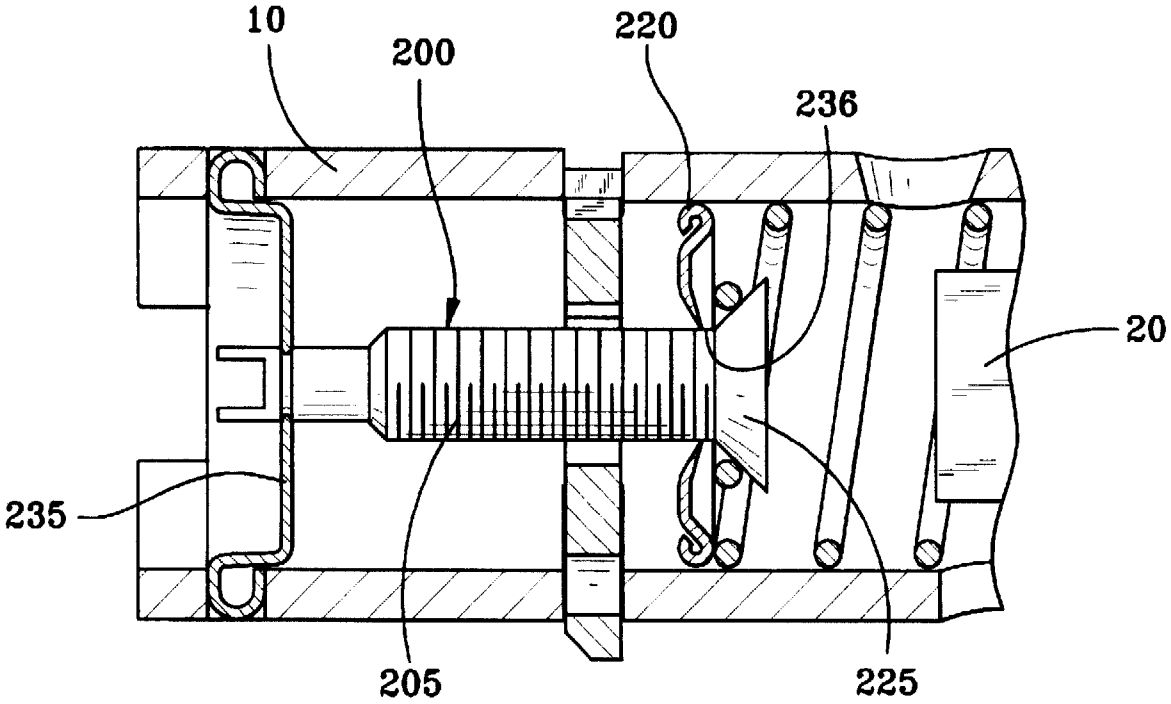
FIG. 9 is a fragmentary schematic cross-sectional plan view of an alternative adjustable biasing arrangement.

FIG. 8 shows the features of the bias spring adjustment mechanism in the inside spindle 10 which is included to compensate for tolerance build-up of the components of the lockset. Spring 21 is attached at its inboard end to the motor 20, as earlier described, by retainer tabs 22. In this embodiment, the outboard end of the spring 21 does not have any ears for attachment to the spindle. Instead, the spring 21 is attached to a spring clamping plate 120, which has a centered hole through which a reduced diameter portion of the unthreaded end 99 of a threaded stud 100 projects. The stud 100 is rotatably held in plate 120 by clips 125 which engage grooves on the stud end 99. Outboard of the plate 120 and spring 21 is a flat substantially rectangular knob catch 130 which also has a centered circular clearance hole through which the unthreaded portion 99 of stud 100 protrudes. Fixed at the outboard end of inside spindle 10 is a cup-shaped anchor 135 with a thread 136 formed at the center of its inboard end. Of course any female threaded connector can be used, such as a molded polymeric unit, or sheet metal fastener. The threaded portion 105 of the stud 100 is engaged in the thread 136 of anchor 135, and through its connection to plate 120, provides a mechanism for adjusting the position of the spring 21 to whatever location is required for proper operation of the lockset. By this means, the stud 100 can be used to adjust the axial position of the motor 20, the gearbox 30, the output shaft 31, and the cam plug 40 relative to the locking slot 56 in hub 55. This assures that the lock will operate with proper timing between the electric motor 20 and the mechanical key cylinder 60. The same adjustability can be accomplished, as in FIG. 9, by rotatably attaching the stud 200 to a flat anchor 235 and having its threaded portion 205 engaging a threaded hole 236 in the clamping plate 220. A headed portion 225 of the stud 200 prevents the stud from being completely unthreaded from the clamping plate 220.

Figure 10A:
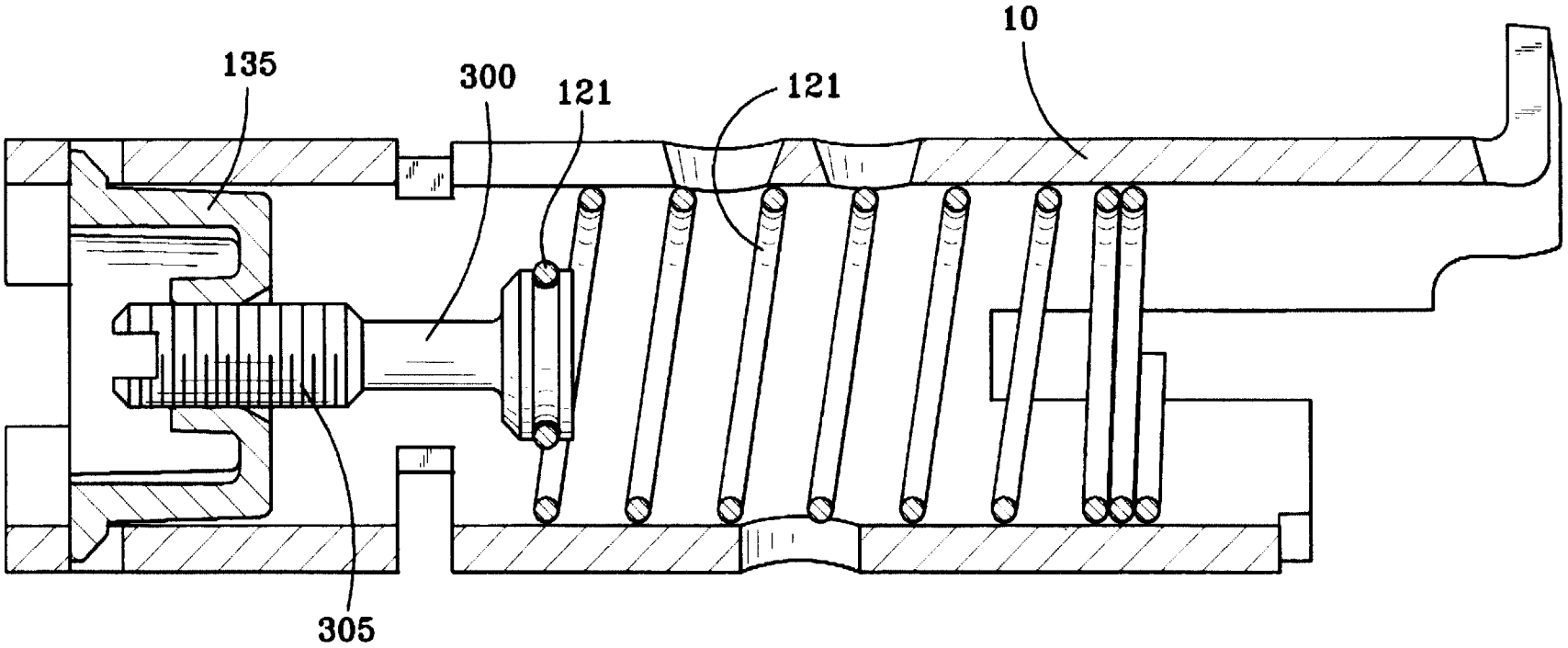
FIGS. 10*a* and 10*b* show a plan view and a perspective view, respectively, of another alternative arrangement for bias adjustment.
Figure 10B:
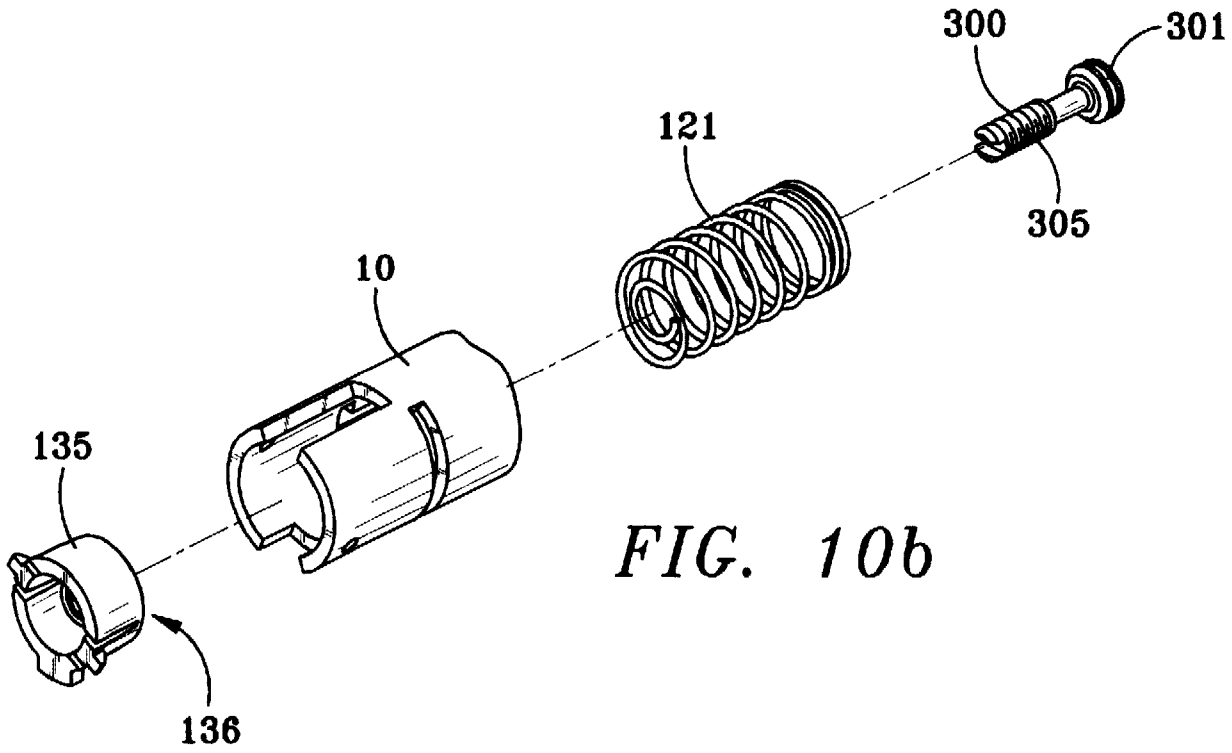

FIGS. 10*a* and 10*b* illustrate yet another embodiment with similar adjustment operation. Plate 120 and clips 125 are eliminated and the stud 100 is engaged with the spring 121 by means of the last outboard coil having a diameter small enough to snap into and grip a groove 301 near the inboard end of stud 300. The spring 121 thereby grips the stud 100, which is free to turn so it may move axially inward and outward in response to the action of the threaded portion 305 with the thread 136 of anchor 135 as previously described.

Having described the invention, we claim:

1. A door lock, operable by an electronic signal and having inside and outside handles mounted on inside and outside hollow spindles, for mounting on a door having an inside face and an outside face, said door lock comprising:

a cylindrical lock chassis having means for retracting a latch bolt in response to rotation of either of said hollow spindles;

means for locking said outside spindle against rotation;

a reversible electric motor mounted coaxially within the inside spindle, said motor being secured against rotation but free to slide axially against resistance provided by a biasing means, and having a motor shaft extending through said cylindrical lock chassis to operably engage the means for locking said outside spindle; and means for moving the means for locking said outside spindle between unlocked and locked positions.

2. The door lock of claim 1, wherein the means for locking said outside spindle against rotation comprises a locking lug which protrudes outwardly through an axial slot in said outer spindle and which is axially movable into engagement with an axial slot in a fixed lock-mounting hub.

3. The door lock of claim 2, further comprising:

a cam plug having said locking lug projecting radially outwardly from a peripheral surface thereof, said cam plug having means for being moved axially by said electric motor when said motor is actuated.

4. The door lock of claim 3, wherein the means for being moved axially by said electric motor comprises a threaded hole in said cam plug for engaging threads on an output shaft of said motor and for thereby moving axially in response to rotation of the output shaft of the motor.

5. The door lock of claim 3, wherein the means for being moved axially comprises a spiral cam operable by a tailpiece driver on a key cylinder, said spiral cam causing said cam plug to move axially in response to rotary movement of said spiral cam.

6. The door lock of claim 1, further comprising:

means for preventing disengagement of said means for locking said outside spindle against rotation by axial impacts to said outside spindle.

7. The door lock of claim 1, further comprising:

means for adjusting and presetting the biasing means against the resistance provided by which said motor is free to slide during operation.

8. The door lock of claim 6 wherein the means for preventing disengagement of said means for locking said outside spindle against rotation by axial impacts to said outside spindle comprises:

an axial slot in a mounting hub fixed to said cylindrical lock housing; a circumferential slot intersecting said axial slot in said mounting hub at an outboard end of said axial slot, said circumferential slot extending substantially half-way around a circumference of said hub such that, when located in said circumferential slot, said locking lug is free to rotate with said spindle to open the door lock, and, when located in said axial slot inboard of said circumferential slot, said locking lug and spindle are locked against rotation; said locking lug being axially held in place by said biasing means.

9. The door lock of claim 7, wherein the means for adjusting and presetting the biasing means against which said motor is free to slide during operation comprises: an anchor member fixed near an outboard end of said inside spindle; and a threaded stud; said biasing means being attached at an inboard end to said motor, and said threaded stud being rotatably connected between an outboard end of said biasing means and said anchor member; said stud being threadably engaged with one of said biasing means and said anchor and axially fixedly engaged with the other one of said biasing means and said anchor for adjusting the position of said motor by said biasing means.

10. A door lock, for mounting on a door having an inside face and an outside face, said lock having inside and outside handles mounted on inside and outside hollow spindles and being operable both by a mechanical key and key cylinder and by an electronic signal, comprising:

a cylindrical lock chassis having inside and outside chassis walls upon which are mounted inside and outside hollow stationary hubs and through which project said inside and outside hollow spindles, respectively, said spindles having latch rollback cams at inner ends thereof;

means, including a locking lug and a hub locking slot in said outside hub, for locking said outside spindle against rotation;

means for causing engagement and disengagement of said locking lug with said hub locking slot and for thereby locking and unlocking said outside spindle by using a mechanical key in a key cylinder;

a reversible electric motor disposed within the inside spindle and coaxial therewith and having a motor shaft extending into said cylindrical lock chassis;

means for mounting said motor with torsional rigidity and axial freedom within said inside spindle;

screw means connected directly to said motor shaft for driving said locking lug along the axis of said outside spindle and for thereby causing engagement and disengagement of said locking lug with said hub locking slot;

means for transmitting signals to operate said motor and to lock and unlock said outside spindle; and means for permitting locking and unlocking by the mechanical key and the electric motor.

11. In a door lock which has an outside handle mounted on an outside spindle which is rotatable for operating a latch retractor mechanism in a latch housing to withdraw a latch bolt from a lock strike pocket in a door frame, said door lock having a locking mechanism for locking said spindle against rotation by movement of a locking lug, said locking mechanism having an axially free radially restrained mounting, into simultaneous engagement with an axial slot in said spindle and a slot in a fixed member of said latch housing, said slots being aligned when said spindle is in a parked position, the improvement in combination with said door lock, comprising:

a radial slot intersecting said axial slot at an outboard end of said axial slot and also outboard of said slot in said fixed member of said latch housing, said locking lug being disposed to project outwardly through said radial slot when in an unlocked state and to project outwardly through said axial slot to engage the slot in said fixed member of said latch housing when in a locked state; and means for axially moving said locking lug from said axial slot to said radial slot, and vice versa.

12. The combination of claim 11 further comprising:

means for limiting axial travel of said locking lug in the inboard direction.

13. An apparatus for allowing adjustment of a bi-directional axial bias imposed on a locking mechanism operated by an electric motor mounted within an inside spindle of a door lock, comprising:

an anchor secured to an outboard end of said spindle;

means for gripping an outboard end of a biasing spring attached to an outboard end of said motor; and means for changing, the distance of separation between said anchor and said means for gripping to adjust the axial position of said motor at zero biasing force of said spring.

14. A door lock, operable by an electronic signal and having inside and outside handles mounted on inside and outside operators respectively and having a locking means for moving a latch bolt from an extended position to a retracted position, the locking means being engaged with the operators, the inside and outside operators being rotatable from a first position wherein the latch bolt is in an extended position to a second position wherein the latch bolt is in a retracted position, the door lock comprising:

a housing;

means for preventing rotation of the outside operator; and a reversible electric motor mounted within the housing, the motor being secured against rotation but free to slide axially against resistance provided by a biasing means and having a motor shaft extending therefrom to operably engage the means for preventing rotation, the motor moving the means for preventing rotation between an unlocked position wherein the outside operator is free to rotate and a locked position wherein the outside operator is locked against rotation.

15. The door lock according to claim 14, wherein the operators are hollow spindles.

16. The door lock according to claim 15, wherein the motor is mounted co-axially within the inside operator.

17. A linear actuator in a lock chassis for causing engagement and disengagement of a locking mechanism with a latch operating device, comprising:

a reversible electric motor having a longitudinal axis, disposed within the chassis and having a motor shaft operably engaged with the locking mechanism;

means for mounting the motor to the lock chassis in a rotationally rigid arrangement while providing linear freedom along the longitudinal axis of the motor; and screw means connected to the motor shaft for causing linear motion of the locking mechanism in response to rotary motion of the motor shaft.

18. The linear actuator according to claim 17, further comprising:

a biasing means for linearly biasing the motor.

19. A linear actuator in a lock chassis for causing engagement and disengagement of a locking mechanism with a latch operating device, comprising:

a reversible electric motor having a longitudinal axis, disposed within the chassis and having a motor shaft operably engaged with the locking mechanism;

means for mounting the motor to the lock chassis in a rotationally rigid arrangement while providing linear freedom along the longitudinal axis of the motor;

screw means connected to the motor shaft for causing linear motion of the locking mechanism in response to rotary motion of the motor shaft; and means for preventing a stall condition of the motor, the means comprising the motor being linearly moveable against a spring force.

* * * * *